US005944122A

United States Patent [19]

Cheers

[11] Patent Number: 5,944,122

[45] Date of Patent: Aug. 31, 1999

[54] METHODS AND APPARATUS FOR CONTROLLING AN AIR COMPRESSOR IN A DRILL STRING FLUSHING SYSTEM

[75] Inventor: Ronald M. Cheers, Gainesville, Fla.

[73] Assignee: Driltech Inc., Alachua, Fla.

[21] Appl. No.: 08/984,989

[22] Filed: Dec. 4, 1997

[51] Int. Cl.[6] ..... E21C 7/00; E21B 21/10

[52] U.S. Cl. ..... 175/71; 175/212

[58] Field of Search ..... 175/71, 212, 25, 175/68, 69

[56] References Cited

U.S. PATENT DOCUMENTS

| | | | |
|---|---|---|---|
| 3,612,192 | 10/1971 | Maguire, Jr. | 175/71 X |
| 3,889,959 | 6/1975 | Persson | 175/212 X |
| 5,249,635 | 10/1993 | King et al. | 175/69 X |
| 5,409,072 | 4/1995 | Enlund et al. | 175/71 |
| 5,775,442 | 7/1998 | Speed | 175/71 X |

*Primary Examiner*—Frank Tsay
*Attorney, Agent, or Firm*—Burns, Doane, Swecker & Mathis, L.L.P.

[57] ABSTRACT

A flushing system for supplying compressed flushing air to a drill string for flushing cuttings during a drilling operation includes an air compressor having an inlet valve at the compressor inlet, and a turnvalve at the compressor outlet. Those valves are biased to a normal state, but when actuated, the inlet valve is to reduce the inlet air volume, and reduce the outlet air volume and pressure. If flushing air conducted to the drill string is temporarily reduced or terminated, while the compressor continues to operate, air pressure builds up and is conducted to both the inlet valve and turnvalve for reducing the volume and pressure of air emitted from the compressor outlet. In this way, the energy required to operate the compressor is significantly reduced.

5 Claims, 4 Drawing Sheets

METHODS AND APPARATUS FOR CONTROLLING AN AIR COMPRESSOR IN A DRILL STRING FLUSHING SYSTEM

BACKGROUND OF THE INVENTION

The present invention relates to subterranean drilling and, in particular, to the supplying of compressed air to a drill string for flushing cuttings and cooling the drill bit.

In FIG. 1 there is depicted a conventional drill string 2 mounted on a mobile carrier 4, and a mechanism 6 for supplying compressed flushing air to the drill string via line 8. That mechanism, depicted in FIG. 2, comprises a compressor assembly 9 including a compressor 10 for compressing air delivered thereto from an inlet line 12. The compressed air is delivered to a storage tank 14 which includes a filter 16 for separating lubricating oil from the air, whereafter the oil is reintroduced upstream of the compressor. The compressed air passes through a minimum pressure valve 18 which maintains a predetermined pressure in the tank. Compressed air from the minimum pressure valve is supplied to a main valve 22, such as a manually operated valve which, when open, supplies compressed working air to the drill string via line 8.

The compressor assembly 9 is of the type having an inlet valve 32 which is spring biased to a normal, fully open state, but when activated can be progressively closed by the application thereto of air pressure to diminish the compressor inlet, thereby reducing the inlet air volume. A compressor assembly 9 having such an inlet valve 32 is available from Sullair Corporation of Michigan City, Ind.

It may be desirable to partially close the inlet valve 32 on certain occasions, such as to facilitate start-up, or to reduce the energy necessary to operate the compressor during periods when air pressure requirements are reduced.

For instance, it may occur during a drilling operation that little or no working air is temporarily required, e.g., during the changing of drill steel, or collaring a hole, or drilling a smaller hole. However, it is desirable to keep the compressor operating. In that event, a pressure build-up occurs which is furnished via line 26 to a subtractive pilot valve 28. When the pressure exceeds a predetermined value, the pilot valve 28 opens and supplies air to a pilot end of a purge valve 30 and to the inlet valve 32 via line 33. As a result, the purge valve 30 is opened to discharge air to the atmosphere via line 27, and the inlet valve 32 is partially closed to partially obstruct the compressor inlet, thereby reducing the air supplied to the compressor 10. A bleed orifice 34 enables air pressure in the line 33 to be dissipated when the supply of compressed air thereto is halted, to enable the inlet valve to reopen.

Due to the closing of the inlet valve 32, the compressor is required to compress less air which reduces the amount of energy required to operate the compressor. The air pressure at the compressor outlet is not affected by the closing of the inlet valve.

However, it would be desirable to further reduce even further the energy required to operate the compressor in such instances.

SUMMARY OF THE INVENTION

The present invention involves a subterranean drilling mechanism comprising a drill string and a flushing system for supplying compressed air to the drill string for flushing cuttings. The flushing system comprises an air compressor having an inlet valve disposed at an air inlet of the compressor, and a turnvalve disposed at an air outlet of the compressor. The inlet valve and turnvalve each being biased to an open state. The turnvalve, when closed, partially obstructs an inlet of the compressor. The turnvalve, when closed partially obstructing the outlet of the compressor. A main valve is disposed downstream of the compressor for supplying compressed working air to the drill string. A first air path communicates compressed air from the compressor outlet with the inlet valve for closing the inlet valve in response to a predetermined build-up of compressed air. A second air path communicates compressed air from the compressor outlet with the turnvalve for closing the turnvalve in response to the predetermined pressure build-up.

The invention also relates to a method of controlling a flushing system for supplying compressed air to a drill string for flushing cuttings. The compressed air is supplied by a compressor having an inlet valve at an air inlet, and a turnvalve at an air outlet. Each of the inlet valve and turnvalve is biased to an open state. The inlet valve, when closed, partially obstructs the air inlet. The turnvalve, when closed partially obstructing the air outlet. The method comprises supplying the drill string with compressed air from the compressor with the inlet valve and turnvalve open, to perform a drilling operation. The amount of compressed air supplied to the drill string is temporarily reduced, while continuing to operate the compressor, causing a pressure build-up to occur. Built-up air pressure is supplied to the inlet valve and the turn valve for closing the inlet valve and turnvalve to reduce the volume and pressure of air emitted from the compressor outlet during step B.

BRIEF DESCRIPTION OF THE DRAWINGS

The objects and advantages of the invention will become apparent from the following detailed description of preferred embodiments thereof in connection with the accompanying drawing in which like numerals designate like elements and in which.

DETAILED DESCRIPTION OF A PREFERRED EMBODIMENT OF THE INVENTION

Figure 1:
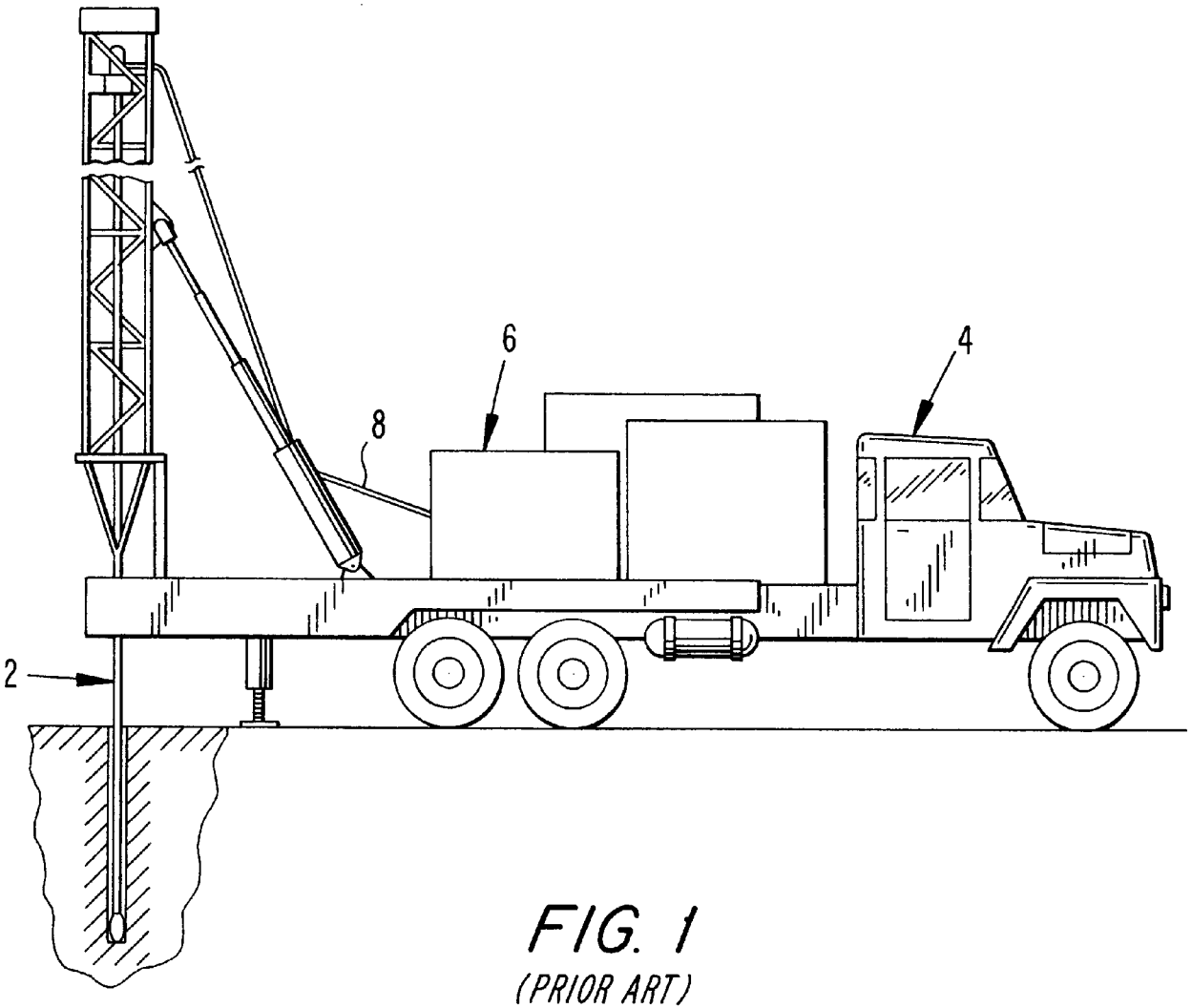
FIG. 1 (PRIOR ART)
FIG. 1 is a schematic site elevational view of a subterranean drilling apparatus to which the present invention can be applied.
Figure 2:
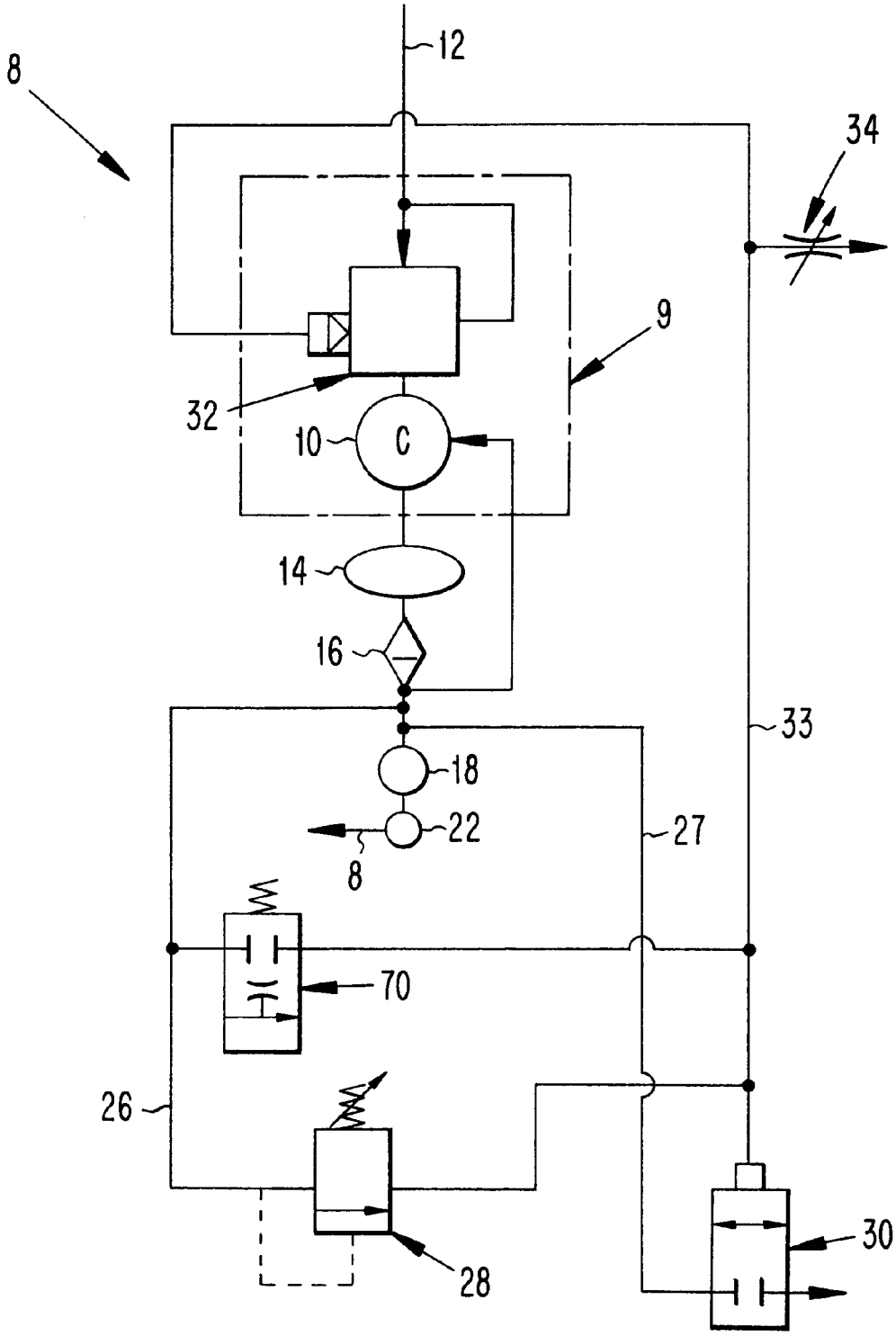
FIG. 2 (PRIOR ART)
FIG. 2 is a schematic view of a conventional mechanism for supplying flushing air to the drill string.
Figure 3:
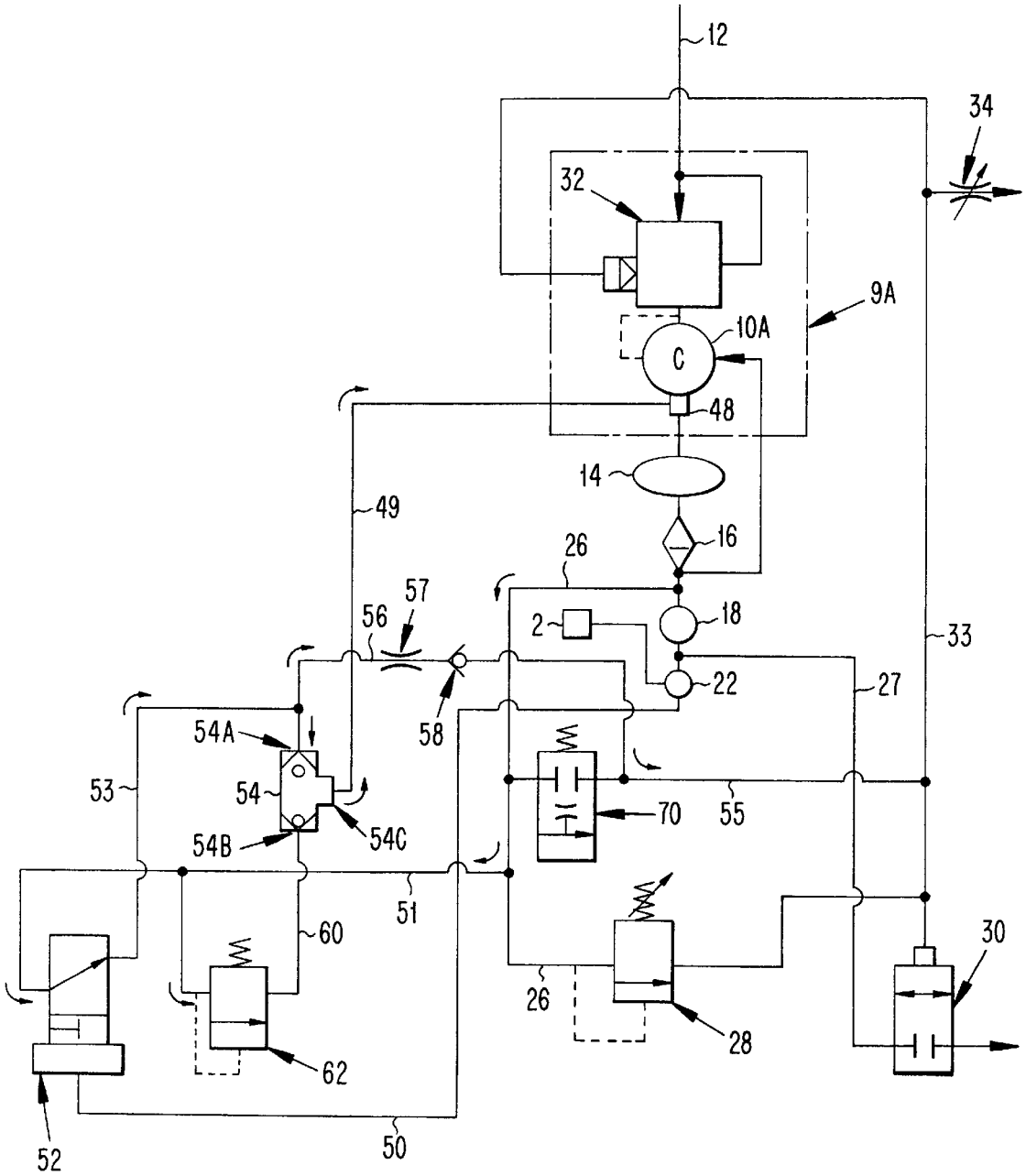
FIG. 3 is a schematic view of a system for supplying flushing air to a drill string according to the present invention, when a main valve is closed.
Figure 4:
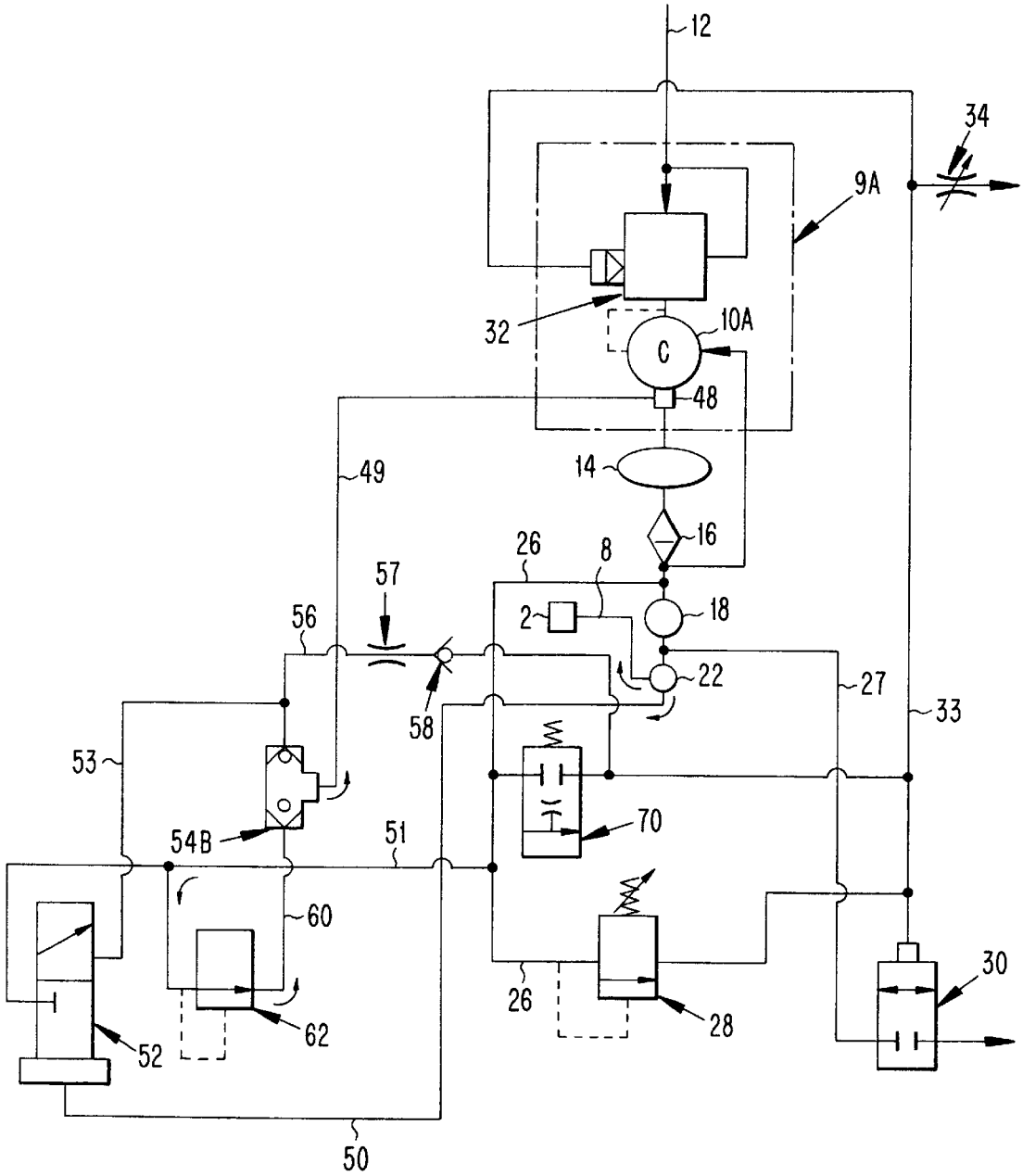
FIG. 4 is a view similar to FIG. 3 depicting the system when the main valve is open.

A preferred embodiment of the invention is disclosed in connection with FIGS. 3 and 4. Components corresponding to those described in connection with FIG. 2 will be given the same reference numerals and their description will not be repeated.

The compressor assembly 9A employed is similar to that of the prior art in that it has the previously described inlet valve 32 at the compressor inlet side. However, the compressor 10A also has, at its outlet side, a turnvalve 48 which is spring-biased to a normal position, but which can be actuated by the application thereto of air pressure suitable for overcoming the spring bias. Such a compressor 10A having a turnvalve 48 is available from Sullair Corporation of Michigan City, Ind. When the turnvalve is actuated, the displacement of the compressor is reduced, decreasing the outlet volume and pressure, and thereby reducing the energy necessary to operate the compressor over and above the reduction produced by merely closing the inlet valve 32.

The present invention involves controlling the turnvalve in a novel manner. This is achieved by providing a line 50 connecting the main valve 22 with a pilot-operated, two-position valve 52 which is normally spring-biased to an open state shown in FIG. 3 wherein the line 26 is communicated via lines 51 and 53 with one inlet side 54A of a double check valve 54, and is also communicated with a line 56 that connects to a line 55. The line 56 contains a pressure reducing orifice 57, such as a 0.09 inch orifice which reduces pressure of air traveling therethrough from left to right in FIG. 3. Also disposed in the line 56 is a one-way check valve 58. The other inlet side 54B of the double check valve 54 communicates with a line 60 which is connected to the line 51. A regulator valve 62 is disposed in the line 60. The outlet side 54C of the double check valve is connected to the turnvalve 48 via line 49.

During start-up of the system, the compressor begins to be driven, and with the main valve 22 closed, air pressure gradually builds. That air pressure communicates with the inlet side 54A of the double check valve 54 through the open valve 52 and via lines 26, 51 and 53. (Note: since the valve 52 is open, the air bypasses the regulator valve 62.) That air pressure communicates with the turnvalve 48 via the outlet side 54C of the double check valve to actuate the turnvalve, whereby the air outlet volume and pressure are reduced, to facilitate start-up. Optionally, a start-up bypass solenoid valve 70 can be provided which is normally spring-biased closed, but which can be manually opened during start-up to communicate the compressed air with the inlet valve 32 in order to actuate the inlet valve by partially closing that valve and thereby, partially obstructing the compressor inlet, to further facilitate start-up, as is conventional.

When the system pressure has been sufficiently built-up, the main valve 22 is opened, and pressurized working air is delivered to the drill string to flush cuttings and cool the drill bit.

Pressurized air is also delivered via line 50 to the pilot side of the valve 52 to close the valve 52, as shown in FIG. 4. Pressure at the turnvalve is thus relieved, causing the turnvalve to open.

Also, the start-up solenoid valve 70 will have been previously manually released, whereby the inlet valve 32 will be fully open. Thus, the compressor operates at full volume and pressure.

During this period, compressed air in line 26 cannot pass through the closed valve 52. Rather, that air communicates with the regulator valve 62. In other words, compressed air cannot reach the double check valve 54 until the regulator valve 62 is opened, as may periodically occur during a drilling operation.

If the main valve 22 is subsequently fully or partially closed (e.g., when a drill steel is being exchanged), and the compressor continues to operate, the line 50 is communicated with the drill string and so the pressure therein falls to zero, whereby the valve 52 automatically opens. Thus, compressed air is able to pass through the inlet side of the double check valve 54 and reach the turnvalve 48 via line 49 to actuate the turnvalve. The built-up air pressure in line 26 will not reach a value sufficient to open the regulator valve 28. However, pressurized air will travel through the line 56, the orifice 57, the check valve 58 and lines 55 and 33, to partially close the inlet valve 32 (e.g., by 50%). (The presence of orifice 57 will keep the air pressure low enough to prevent the inlet valve from completely closing the inlet valve.)

As a result, the outlet volume and pressure from the compressor is significantly reduced to minimize the expenditure of energy in running the compressor.

The system according to the present invention thus enables the outlet air pressure as well as the outlet air volume to be controlled, thereby achieving considerable savings in compressor-driving energy during period where little or no working air is required.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A subterranean drilling mechanism comprising a drill string, and a flushing system for supplying compressed air to the drill string for flushing cuttings, the flushing system comprising:

an air compressor having an inlet valve disposed at an air inlet of the compressor, and a turnvalve at an air outlet of the compressor, the inlet valve and turnvalve each being biased to a normal state; the inlet valve, when actuated, reducing the inlet air volume; the turnvalve, when actuated, decreasing the outlet air volume and pressure;

a main valve disposed downstream of the compressor for supplying compressed working air to the drill string;

a first air path for conducting compressed air from the compressor outlet to the inlet valve for actuating the inlet valve in response to a predetermined build-up of compressed air when the main valve is closed; and a second air path for conducting compressed air from the compressor outlet to the turnvalve for actuating the turnvalve in response to the predetermined pressure build-up when the main valve is closed.

2. The apparatus according to claim 1 further including a normally open valve disposed in the second path, the normally open valve including a pilot side connected downstream of the main valve for closing the normally open valve when the main valve is open.

3. The apparatus according to claim 2 further including a double check valve having first and second inlets and an outlet, the outlet communicating with the turnvalve, the first inlet communicating with an outlet of the normally open valve; there being a pressure regulator valve having an inlet communicating with the second path at a location upstream of the normally open valve; an outlet of the pressure regulating valve communicating with the second inlet of the double check valve.

4. The apparatus according to claim 3 wherein the first path is connected to the second path at a location between the normally open valve and the first inlet of the double check valve, the first path including a pressure reducing orifice and a one-way check valve permitting a flow of pressurized air toward the inlet valve but not in a reverse direction.

5. A method of controlling a flushing system for supplying compressed air to a drill string for flushing cuttings, the compressed air supplied by an air compressor having an inlet valve at an air inlet, and a turnvalve at an air outlet, the inlet valve and turnvalve each biased to a normal state; the inlet valve, when actuated, reducing the inlet air volume; the turnvalve, when actuated, reducing the air outlet volume and pressure; the method comprising the steps of:

A) supplying the drill string with compressed air from the compressor with the inlet valve and turnvalve open to perform a drilling operation;

B) temporarily reducing or stopping the amount of compressed air supplied to the drill string, while continuing to operate the compressor, causing an air pressure build-up to occur; and C) supplying the built-up air pressure to the inlet valve and the turnvalve for actuating the inlet valve and turnvalve to reduce the volume and pressure of air emitted from the compressor outlet during step B.

* * * * *